United States Patent [19]

Robinson et al.

[11] 4,398,402

[45] Aug. 16, 1983

[54] KNITTING METHOD AND KNITTED GARMENT

[75] Inventors: Frank Robinson; Nigel S. Whatmough, both of Breaston, England

[73] Assignee: Courtaulds Limited, London, England

[21] Appl. No.: 242,327

[22] Filed: Mar. 10, 1981

[30] Foreign Application Priority Data

Mar. 13, 1980 [GB] United Kingdom ..... 8008639

[51] Int. Cl.[3] ..... A41B 9/06

[52] U.S. Cl. ..... 66/176

[58] Field of Search ..... 66/177, 175, 176

[56] References Cited

U.S. PATENT DOCUMENTS 3,057,178 10/1962 Konklin ..... 66/176

3,635,051 1/1972 Betts et al. ..... 66/176

FOREIGN PATENT DOCUMENTS 452770 5/1968 Switzerland ..... 66/176

*Primary Examiner*—Ronald Feldbaum

*Attorney, Agent, or Firm*—Davis, Hoxie, Faithfull & Hapgood

[57] ABSTRACT

A method of knitting a blank for a garment comprises the steps, carried out in a sequence involving knitting from one waist line to the other in the blank, of (a) knitting two front panels for the garment body with courses extending lengthwise of each front body panel and wales extending in the direction across each front body panel, in the finished garment; (b) knitting two sleeve panels for the garment with courses extending lengthwise of each sleeve panel; and (c) knitting a single rear panel for the garment body with courses extending across the rear panel and wales extending lengthwise of the rear panel. During the knitting, joins are formed between the front panels and the associated sleeve panels by a process involving the procedures of taking needles out of action while holding knitted loops on those needles, and then reintroducing the inactive needles to knitting action, at least one of said procedures being carried out progressively so that suture joins are produced. Also during the knitting, joins are formed between the rear panel and the sleeve panels by forming knitted wales which extend from the sleeve panels into the rear panel.

3 Claims, 3 Drawing Figures

KNITTING METHOD AND KNITTED GARMENT

This invention relates to a method of knitting a blank for a sleeved garment in such a way that the blank comprises at least all the major parts of the garment integrally joined together but requiring some major seams to be completed in order to secure the parts together in the form of a finished garment.

According to the invention a method of knitting a blank for a garment comprises, in the following order, or in the reverse order, the steps of: knitting two front panels for the garment body with courses extending lengthwise of each front body panel and wales extending in the direction across each front body panel, in the finished garment; knitting two sleeve panels for the garment with courses extending lengthwise of each sleeve panel; and knitting a single rear panel for the garment body with courses extending across the rear panel and wales extending lengthwise of the rear panel; and during knitting forming a join between each front panel and an associated sleeve panel by a process involving the procedures of taking needles out of action whilst holding knitted loops on those needles, and then reintroducing the inactive needles to knitting action, at least one of said procedures being carried out progressively so that a suture join is produced; and further during knitting forming a join between the rear panel and each sleeve panel by forming knitted wales which extend from the sleeve panels into the rear panel.

The invention also includes a knitted garment blank comprising two front panels for the garment body with courses extending lengthwise of each front body panel and wales extending in the direction across each front body panel, in the finished garment, two sleeve panels with courses extending lengthwise of each sleeve panel, and a single rear panel with courses extending across the rear panel and wales extending lengthwise of the rear panel, each front panel and an associated sleeve panel being integrally joined by a knitted suture and each sleeve panel being integrally joined to the single rear panel.

The invention also includes a knitted garment made from a blank as just described.

Figure 1:
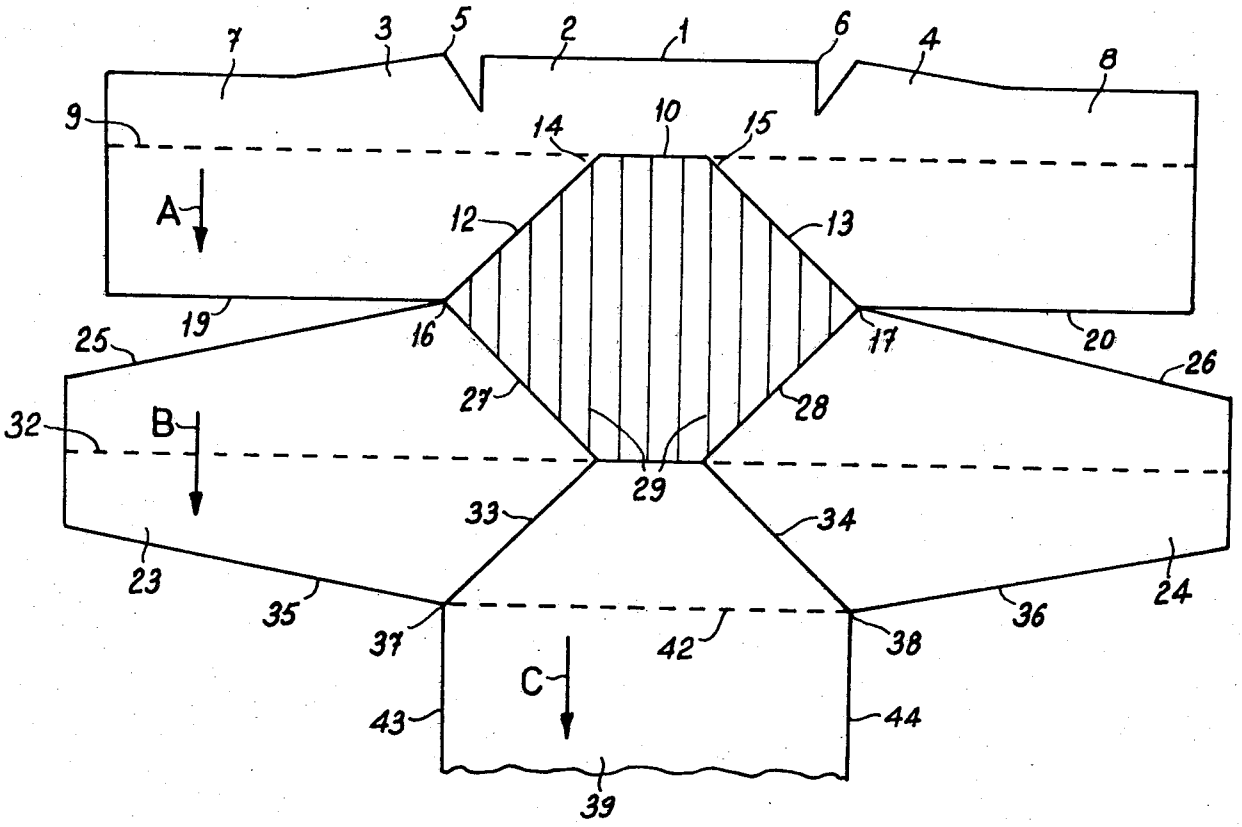
Figure 2:
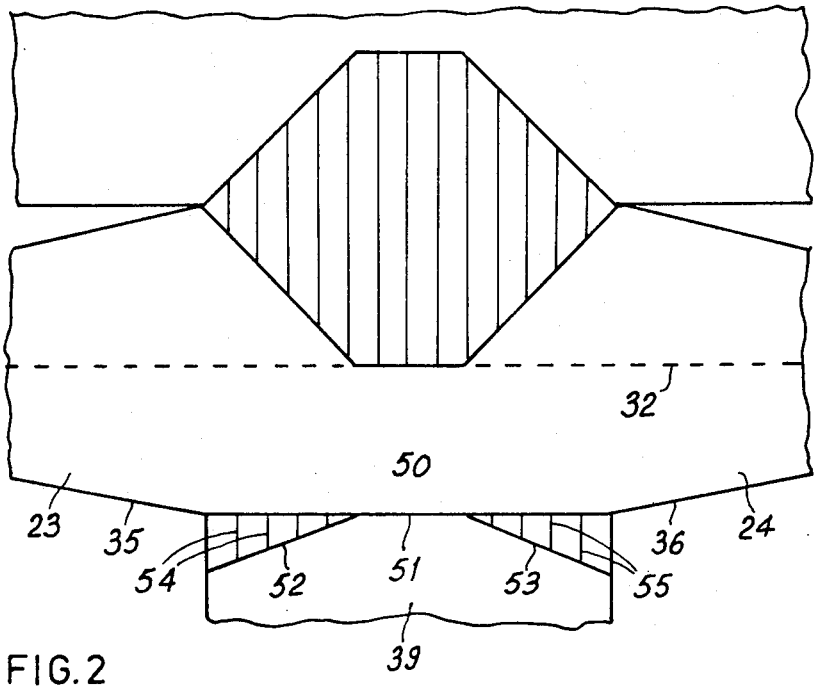
Figure 3:
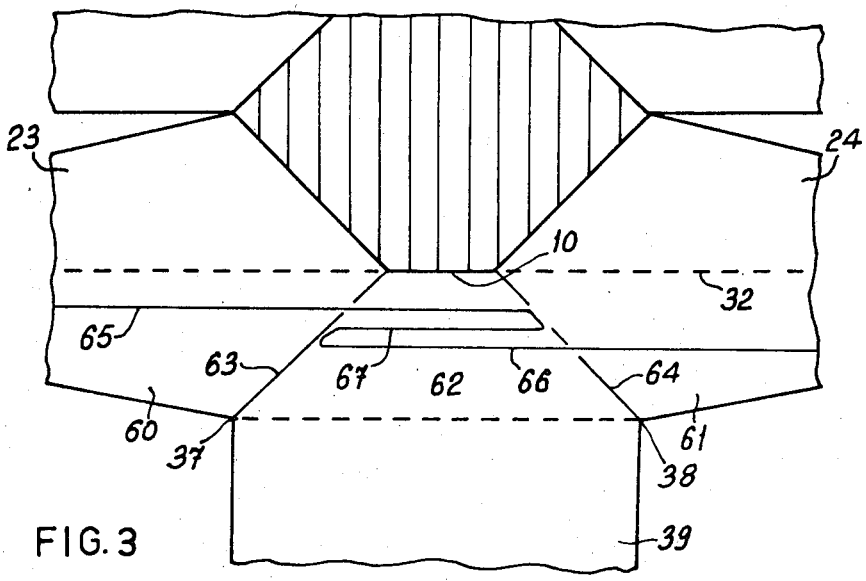

The invention will be further described, by way of example, with reference to the accompanying drawings, in which:

FIG. 1 is a diagram illustrating a knitting method according to the invention and the garment blank produced using that method, FIG. 2 is a diagram similar to FIG. 1 illustrating another knitting method according to the invention and the garment blank produced using that method, and FIG. 3 is a diagram illustrating an alternative knitting procedure for joining the sleeve panels to the rear panel in producing a garment blank according to the invention.

The garment blanks shown in the drawings are knitted on a flat V-bed knitting machine. Such machines have independently operable needles arranged in two opposed needle beds. The machine used in carrying out the present knitting method should be modified by incorporation of means supplementing or replacing normal take-down rollers and facilitating the carrying out of knitting operations in which some needles are taken out of action whilst holding their loops and other adjacent needles continue to knit. Such a modified flat knitting machine may incorporate a device for pressing down the knitted fabric from above as an alternative to conventional roller take-down. A device of this kind is now commonly known as a 'presser-foot' and one such device is described in British Patent Specification No. 1,288,043 (corresponding to U.S. Pat. No. 3,613,401). Flat V-bed knitting machines currently fitted with presser feet in commercial production are those manufactured by the firm of Edouard Dubied & Cie, Switzerland under the designations JDR-PM and JET 2F; by the firm of Bentley-Allemania Limited, England under the designation Euro-210; and by the firm of Mitsuboshi Seisakusho Co. Ltd., Japan under the designations DJFU/J-F Type and MAC II-F.

Knitting of the garment blanks shown in the drawings may be begun either by starting knitting at the neck region and front body panels or by starting knitting at the rear body panel. Whichever direction of knitting is chosen the knitting procedure is essentially the same and only the procedure starting at the neck region and front body panels will be described in detail in this specification. This procedure has the considerable advantage that it results in a secure edge construction being formed along the free edge of the garment collar and along the free edges of the front body panels, at the centre front of the garment. Thus, when using this procedure, the garment does not require finishing along these edges and this can result in significant savings in making up costs.

In the knitting procedure to be described with reference to FIG. 1, knitting is started by forming the first course 1 of a collar 2 for the garment blank. On completion of the collar 2, the needles holding loops of the collar are put out of action whilst retaining their loops, and the revers 3 and 4 are next knitted commencing with a few courses along the length of the upper edges of the panels 7 and 8 in FIG. 1, and along the free edges of the revers 3 an 4. Thereafter knitting on the needles holding loops in these courses is stopped except in the region of the points 5 and 6. Knitting is continued using progressively longer courses as more and more needles are brought into action to form the revers 3 and 4. When the revers 3 and 4 have been completed, further needles are brought into action and knitting is continued over the full length of both panels 7 and 8 of the blank, in the direction of the arrow A, up to the line 9. Here, a block of needles holding loops in the central part 10 of the shoulder region of the garment blank is taken out of action but the last-knitted loops are retained on those needles. Thereafter, needles are progressively taken out of action along the lines 12 and 13 in the blank, in outward directions along the beds of the knitting machine. Thus, the first needles made inactive in this progressive procedure are in the areas 14 and 15 in the upper part of the shoulder regions, and the last needles made inactive are in the arm pit regions 16 and 17. All the needles made inactive as far as the arm pit regions 16 and 17 are caused to retain their loops.

Upon completion of the front body panels 7 and 8, at the lines 19 and 20, the needles of the knitting machine are operated to cast off their loops along these lines. The needles holding loops of the region 10 and loops in the lines 12 and 13 still retain those loops.

Knitting of two sleeve panels 23 and 24 for the garment in the direction of the arrow B is now begun in the arm pit regions 16 and 17. Initially a few courses are knitted along the edges 25 and 26. The needles holding the loops in these edges are then taken out of action and a short course is knitted in each sleeve panel. The course length is then progressively increased by bringing more needles into action. This needle introduction takes place at both ends of the courses and may occur after each course or after a chosen number of courses have been knitted. Each introduction may involve one or more needles.

Along the edges 25 and 26 of the sleeve panels 23 and 24 needle introduction at this stage involves starting knitting on needles holding loops of the few initial courses along these edges. Along lines 27 and 28 in the shoulder region of the blank, needle introduction involves re-starting knitting on needles which are already holding loops in the lines 12 and 13. Thus, the lines 27 and 28 are integrally joined to the lines 12 and 13 respectively in the knitting process and because needle introduction proceeds along the needle beds in the opposite directions from that in which needles were taken out of action, a suture is formed along the line (12, 27) and along the line (13, 28). The fact that lines 12 and 27 and lines 13 and 28 are coincident is indicated in the drawing by the connecting lines 29. The inactive needles holding the loops in the central part 10 of the shoulder region of the blank remain inactive throughout this stage of the knitting process. At this point, knitting has reached the central upper line 32 in the sleeve panels 23 and 24 and as knitting continues further, needles are progressively taken out of action along the lines 33 and 34 in the rear part of the shoulder region of the garment blank whilst retaining their loops. In the final stage of knitting the sleeve panels 23 and 24, needles are taken out of action progressively along the lines 35 and 36 in order to form the sleeve panels in a desired shape. The needles holding loops in the lines 35 and 36 are operated to press off those loops as the needles become inactive.

On completion of the sleeve panels 23 and 24 in the arm pit regions 37 and 38, knitting of a single rear panel 39 for the garment blank is begun. The first stage in knitting the rear panel 39 is the re-introduction en bloc of the needles holding the loops of the central part 10 of the shoulder region of the blank. Thereafter, needles are progressively re-introduced to knitting action along the lines 33 and 34, the rear panel 39 being thus progressively widened as the courses used in its formation increase in length. Since the needles holding loops along the lines 33 and 34 retained those loops when previously taken out of action, re-introduction of these needles causes the rear panel to be integrally joined to the sleeve panels, but because here needle introduction proceeds in each case in the same direction along the needle beds as needles were taken out of action, sutures are not formed along the lines 33 and 34. Nevertheless, knitted wales are formed which extend from the sleeve panels into the rear panel.

After the arm pit level is reached at the course 42 in the rear panel 39, knitting is continued in the direction of the arrow C to the garment waist where the blank is pressed off the needles of the knitting machine.

The garment blank is made up into a garment by joining the edge 19 of the front body panel 7 to a side edge 43 of the rear panel 39 and the edge 20 of the front body panel 8 to the other side edge 44 of the rear panel 39. The join may be made by means of a conventional seaming procedure on a sewing machine. The edges 25 and 35 of the sleeve panel 23 and the edges 26 and 36 of the sleeve panel 24 are also seamed together by seams located underneath the arms in the finished garment and extending into the arm pits of the garment.

The knitted blank illustrated in FIG. 2 is knitted in the same way as the blank of FIG. 1 as far as the course 32. From this course onwards, the sleeve panels 23 and 24 are completed by knitting courses extending continuously from cuff to cuff of the garment blank. The rear shoulder region 50 of the blank is thus knitted at the same time as the latter halves of the sleeve panels and there are no join lines between the region 50 and the sleeve panels. The sleeve panels 23 and 24 are shaped along the lines 35 and 36 by making the knitted courses progressively shorter at both ends.

After completion of the course 51, the knitting of the rear panel 39 is begun and in order to impart a downward inclination to the sleeves the panel 39 is shaped by knitting a short first course for the panel during knitting of which all the needles involve in knitting the course 51 but not required to form loops of the first course of the panel 39 are maintained out of action. Knitting of the panel 39 is continued by knitting courses which are made progressively longer at both ends, inactive needles holding loops of the course 51 being brought progressively back into action and two sutures being formed joining the rear panel 39 to the region 50 along lines 52 and 53.

The unbroken lines 54 and 55 indicate the integral nature of the joins along the lines 52 and 53 where wales extend from the sleeve panels into the rear panel.

After the lengthening courses reach the full width of the panel 39, knitting is continued to the garment waist and the blank is then pressed off. The blank is made up into a garment in a similar manner to the blank of FIG. 1.

FIG. 3 illustrates a further procedure for joining the sleeve panels to the rear panel. Again the knitting procedure as far as the course 32 is the same as in knitting the blank of FIG. 1. Thereafter, the inactive needles holding loops of the central part 10 of the shoulder region of the garment blank are brought back into action and the remaining parts 60 and 61 of the sleeve panels 23 and 24 and the part 62 of the rear panel are knitted simultaneously.

In knitting these parts, courses are knitted extending into the sleeve part 60 or 61 and across the rear panel part 62 to end on a join line 63 and 64 extending from the neck region of the garment to the arm pit 37 and 38. Courses are also knitted extending only across the part 62 and having an end on the line 63 and the other end on the line 64. In FIG. 3, one course 65 extending into the part 60 and ending on the line 64, one course 66 extending into the part 61 and ending on the line 63 and one course 67 having an end on the line 63 and an end on the line 64 are illustrated. As the knitting progresses, the lengths of the courses 65, 66 and 67 are progressively increased in length so that the lines 63 and 64 are inclined so as to shape the part 62.

Instead of knitting courses on the pattern indicated in FIG. 3, courses extending from cuff to cuff through the part 62 may be formed interspersed with courses having ends on the lines 63 and 64. The overall object is to produce wales in the part 62 which are longer than other wales in the part 62, the length of the wales decreasing in general outwards from the neck region towards the arm pits. The decrease may be progressive from wale to wale. The result is to produce a pouch-like formation imparting a downward inclination to the sleeves and a raglan style to the garment.

Other garment styles may be achieved by varying the pattern of alteration in wale length in the part 62.

What is claimed is:

1. A method of knitting a blank for a garment comprises the following steps carried out in a sequence involving knitting from one waist line to the other in the blank:

(a) knitting two front panels for the garment body with courses extending lengthwise of each front body panel and wales extending in the direction across each front body panel, in the finished garment;

(b) knitting two sleeve panels for the garment with courses extending lengthwise of each sleeve panel; and (c) knitting a single rear panel for the garment body with courses extending across the rear panel and wales extending lengthwise of the rear panel; and (d) during knitting forming a join between each front panel and an associated sleeve panel by a process involving the procedures of taking needles out of action whilst holding knitted loops on those needles, and then reintroducing the inactive needles to knitting action, at least one of said procedures being carried out progressively so that a suture join is produced; and (e) further during knitting forming a join between the rear panel and each sleeve panel by forming knitted wales which extend from the sleeve panels into the rear panel.

2. A knitted garment blank comprising (a) two front panels for the garment body with courses extending lengthwise of each front body panel and wales extending in the direction across each front panel, in the finished garment, (b) two sleeve panels with courses extending lengthwise of each sleeve panel, and (c) a single rear panel with courses extending across the rear panel and wales extending lengthwise of the rear panel, (d) each front panel and an associated sleeve panel being integrally joined by a knitted suture and (e) each sleeve panel being integrally joined to the single rear panel.

3. A method of making a knitted garment comprising the steps of:

(a) knitting a blank according to the method claimed in claim 1, (b) joining front and rear body panels together along side edges thereof and joining edges of the sleeve panels together.

* * * * *